US008172555B2

(12) United States Patent
Reynolds

(10) Patent No.: US 8,172,555 B2
(45) Date of Patent: May 8, 2012

(54) DIAPHRAGM FOAM PUMP

(75) Inventor: Aaron R. Reynolds, North Canton, OH (US)

(73) Assignee: GOJO Industries, Inc., Akron, OH (US)

( * ) Notice: Subject to any disclaimer, the term of this patent is extended or adjusted under 35 U.S.C. 154(b) by 391 days.

(21) Appl. No.: 12/488,146

(22) Filed: Jun. 19, 2009

(65) Prior Publication Data

US 2009/0317270 A1 Dec. 24, 2009

(51) Int. Cl.
*F04B 17/00* (2006.01)

(52) U.S. Cl. ..... 417/413.1; 417/222.1; 417/415; 417/199.1; 222/207; 222/209

(58) Field of Classification Search ..... 417/413.1, 417/222.1, 76, 87, 415, 199.1; 222/190, 222/207, 209
See application file for complete search history.

(56) References Cited

U.S. PATENT DOCUMENTS

| | | | | |
|---|---|---|---|---|
| 2,087,465 | A | 7/1937 | Bacher | |
| 3,151,778 | A | 10/1964 | Olney | |
| 5,054,688 | A * | 10/1991 | Grindley | 239/407 |
| 5,716,007 | A * | 2/1998 | Nottingham et al. | 239/332 |
| 6,216,573 | B1 | 4/2001 | Moutafis | |
| 6,371,332 | B1 * | 4/2002 | Fox | 222/190 |
| 7,128,541 | B2 | 10/2006 | Kach | |
| 7,201,097 | B2 | 4/2007 | De Koning | |
| 2005/0258192 | A1 * | 11/2005 | Matthews et al. | 222/190 |
| 2007/0040048 | A1 * | 2/2007 | Poizot | 239/343 |
| 2007/0228071 | A1 | 10/2007 | Kamen | |
| 2007/0241137 | A1 * | 10/2007 | Willis et al. | 222/190 |
| 2009/0200340 | A1 * | 8/2009 | Ophardt et al. | 222/190 |

* cited by examiner

*Primary Examiner* — Charles Freay
*Assistant Examiner* — Todd D Jacobs
(74) *Attorney, Agent, or Firm* — Calfee, Halter & Griswold LLP

(57) ABSTRACT

A foam pump including a diaphragm made of a flexible material defining a mixing chamber and having an inlet and an outlet. An inlet passageway, having a one-way valve therein, is in fluid communication with a reservoir containing a foamable liquid and the inlet. The inlet passageway includes an air inlet and associated one-way valve. The pump includes an outlet passageway, having a one-way valve therein, in fluid communication with the outlet. The foam pump includes an electric motor. that drives a motor driven element to collapse and expand the diaphragm. Expansion of the diaphragm creates a vacuum causing foamable liquid and air to flow into the mixing chamber. Collapsing of the diaphragm causes the liquid and air mixture to be forced out as foam.

16 Claims, 2 Drawing Sheets

DIAPHRAGM FOAM PUMP

FIELD OF THE INVENTION

The invention herein resides in the art of foam pumps, wherein a foamable liquid and air are mixed to generate a foam product. More particularly, the invention relates to diaphragm foam pumps wherein a diaphragm is caused to repeatedly collapse and expand by a motor driven element, thereby alternately drawing foamable liquid and air into a mixing chamber within the diaphragm and forcing the mixture out as a foam product.

BACKGROUND OF THE INVENTION

For many years, it has been known to dispense liquids, such as soaps, sanitizers, cleansers, disinfectants, and the like from a dispenser housing maintaining a refill unit that holds the liquid and provides the pump mechanisms for dispensing the liquid. The pump mechanism employed with such dispensers has typically been a liquid pump, simply dispensing a predetermined quantity of the liquid upon movement of an actuator. Recently, for purposes of effectiveness and economy, it has become desirable to dispense the liquids in the form of foam generated by the interjection of air into the liquid. Accordingly, the standard liquid pump has given way to a foam generating pump, which necessarily requires means for combining the air and liquid in such a manner as to generate the desired foam.

Typically foam dispensers generate foam by pumping a foamable liquid stream and an air stream to a mixing area and forcing the mixture through a screen to better disperse the air as bubbles within the foamable liquid and create a more uniform foam product. The more minute and numerous the air bubbles the thicker and softer the foam, although too much or too little air can cause the foam to be of poor quality. The key to a desirable foam product is violent mixing of the foamable liquid and air to disperse the air bubbles within the liquid. Many existing foam pump designs employ a piston type mechanism, which results in a fixed volume of foam generated by each activation of the foam pump, without any ability to adjust. Thus, there is a need for a foam pump providing the ability to adjust the volume of foam provided by each activation of the foam pump.

SUMMARY OF THE INVENTION

A diaphragm foam pump including a diaphragm made of a flexible material defining a mixing chamber and having an inlet opening and an outlet opening. An inlet passageway is in fluid communication with a reservoir containing a foamable liquid and the inlet opening, with the inlet passageway having a one-way valve therein. The pump also includes an outlet passageway in fluid communication with the outlet opening and having a one-way valve therein, and an air inlet in the inlet passageway having a one-way valve. The diaphragm foam pump further includes an electric motor and a motor-driven element associated with said electric motor. Actuating the electric motor drives the motor driven element to repeatedly collapse and expand the diaphragm, and where expansion of the diaphragm creates a vacuum causing foamable liquid and air to flow into the mixing chamber, and collapsing of the diaphragm causes the liquid and air mixture to be forced out through the outlet passageway as foam.

DETAILED DESCRIPTION OF ILLUSTRATIVE EMBODIMENTS

Figure 1:
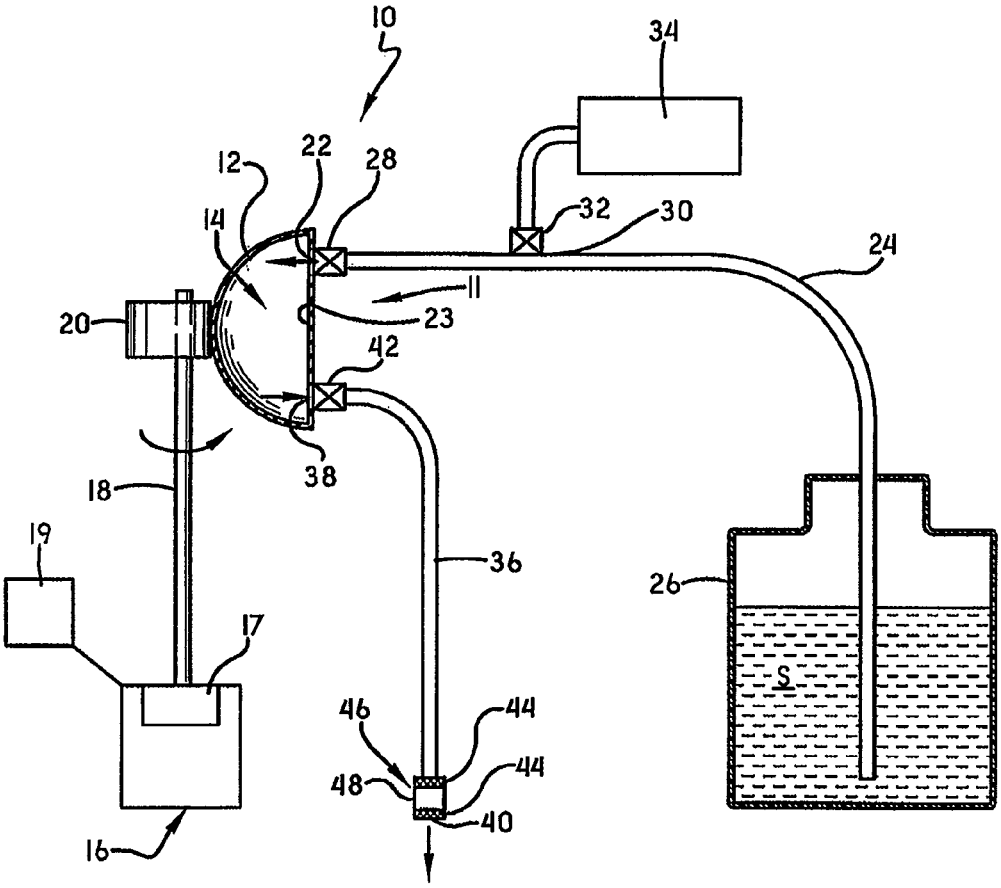
FIG. 1 is a schematic of a dispenser according to the concepts of the present invention.

A dispenser according to the concepts of the present invention is shown in FIG. 1 and is indicated generally by the numeral 10. Dispenser 10 includes a foam pump 11 having a diaphragm 12 that is generally dome shaped. Diaphragm 12 is made of a flexible and resilient material that collapses upon the introduction of an external force, and then returns to its original shape when the force is removed. Suitable materials include, for example, silicone, thermoplastic elastomers, and the like. Diaphragm 12 defines an internal mixing chamber 14 therein, as will be discussed in greater detail below. Diaphragm 12 may be mounted in a dispenser housing (not shown) that provides a mounting mechanism, as well as a means for securing other components of dispenser 10.

Figure 2:
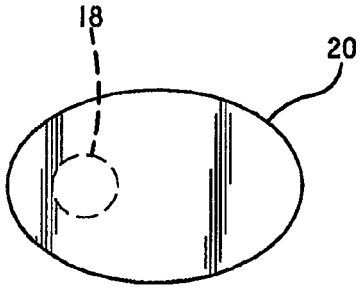
FIG. 2 is a top view of the cam according to FIG. 1.
Figure 3:
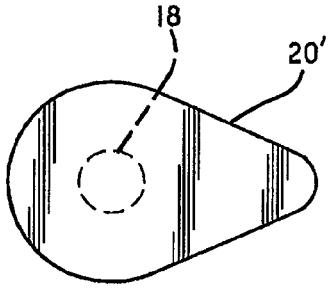
FIG. 3 is a top view of an alternate cam according to another embodiment of the present invention.

Dispenser 10 also includes an electric motor 16 having a rotating motor shaft 18. Electric motor 16 may be any known electric motor having a rotating shaft, including, for example, a DC motor provided with a battery power source 19. Motor 16 may include motor drive circuitry 17 to control the activation thereof (e.g. duration, speed, etc.). The drive circuitry 17 of motor 16 may be actuated by a hands free activation sensor, as is known in the art. A cam 20 is secured to rotating shaft 18 so that rotating shaft 18 causes rotation of cam 20. In FIGS. 1 and 2, cam 20 is shown mounted off-center on shaft 18 so that rotation of shaft 18 is capable of generating linear force to act on diaphragm 12, which thus functions like a cam follower. However, as seen in FIG. 3, the cam can also be a simple center-mounted wheel with an appropriate projection, as at cam 20'.

As seen in FIG. 1, motor 16 is positioned so that shaft 18 extends adjacent to diaphragm 12, separated therefrom by a distance chosen such that, at at least one point during full rotation of shaft 18 (and thus cam 20), diaphragm 12 can assume its fully extended shape. As shaft 18 of motor 16 rotates, cam 20 repeatedly applies a force on diaphragm 12, thereby causing diaphragm 12 to collapse as it rotates into it, and diaphragm 20 then expands back to its original position as cam 20 continues its rotation.

Diaphragm 12 includes an inlet opening 22 on a base 23 thereof, the inlet opening being in fluid communication with an inlet passageway 24 that is in fluid communication with a container 26 holding a foamable liquid S. As shown, inlet passageway 24 is a tube that is submersed at one end in foamable liquid S. A one-way valve 28 is provided in inlet passageway 24 to permit fluid to flow into mixing chamber 14 while preventing fluid flow in the opposite direction toward reservoir 26. One-way valve 28 may be any such valve known in the art, and may include, for example, a ball-valve, a duck-bill valve, a flapper valve, and the like. Inlet passageway 24 also includes an air inlet 30 therein that permits air to be drawn into and mixed with foamable liquid S in inlet passageway 24, as will be appreciated from further disclosures below. Air inlet 30 includes a one-way valve 32, similar to valve 28, to prevent air or liquid from escaping from inlet passageway 24.

Although shown schematically to broadly disclose the concepts of this invention, it should be appreciated that the diaphragm 12 is a well-known pump structure, and, as known, might be secured to a container to provide what is generally known as a refill unit for a dispenser housing. In the soap and sanitizer dispensing arts in particular, it is common to provide a dispenser housing that is adapted to receive a refill unit comprised of a soap or sanitizer container with a diaphragm pump secured thereto. Such a refill unit could be employed, with the diaphragm being acted upon as disclosed herein to dispense product.

Outlet passageway 36 is in fluid communication with an outlet opening 38 in base 23. Outlet passageway 36 is in the form of a tube, and terminates at opening 40. A one-way valve 42 is provided in outlet passageway 36 to allow fluid flow from diaphragm 12 but to prevent fluid flow in the opposite direction. Like one-way valve 28, valve 42 may be any such valve known in the art, and may include, for example, a ball-valve, a duck-bill valve, a flapper valve, and the like.

Upon activation of motor 16, shaft 18 and cam 20 are rotated for a fixed period of time, as controlled by the control circuitry. Rotation of cam 20 causes repeated and rapid collapsing and expanding of diaphragm 12 as cam 20 rotates into and away from diaphragm 12. Each time diaphragm 12 is collapsed, the decreased inner volume of mixing chamber 14 generates a high pressure, which forces the contents of mixing chamber 14 out through one-way valve 42 and into outlet passageway 36. As diaphragm 12 expands back to its original position, the inner volume of mixing chamber 14 increases, creating a vacuum. The vacuum draws both air and foamable liquid along inlet passageway 24 and into mixing chamber 14 through one-way valve 28. Air is drawn into inlet passageway 24 through a one-way valve 32 at opening 30. In one embodiment, the air is drawn into passageway 24 simply due to the movement of liquid past opening 30, i.e., by virtue of a venturi effect. As known by persons skilled in the art, the venturi effect can be enhanced by restricting the flow within passageway 24 adjacent to air inlet 30 to increase the velocity of the flow, and therefore decrease pressure at the point of restricted flow. Alternatively, an air pump 34 may be employed to provide pressurized air at air inlet 30. Air pump 34 may be controlled by control circuitry 17 of electric motor 16, so that activation of motor 16 simultaneously causes activation of air pump 34.

Air drawn into inlet passageway 24 coarsely mixes with foamable liquid S. Due to the high speed rotation of cam 20, and thus the rapid frequency of expanding and collapsing of diaphragm 12, the air and foamable liquid are violently agitated and more thoroughly mixed as they cycle through mixing chamber 14. This mixture is advanced to opening 40 and dispensed as foam. The time period of motor actuation may be adjusted by altering control circuitry 17 to control the amount of foam that is dispensed upon each activation of foam pump 10. The rate of rotation can also be altered for a given liquid/air mixture, because it may be found that different mixtures turn to foam under lesser or greater agitation.

Outlet passageway 36 may optionally include at least one mesh screen 44 adjacent opening 40 for extrusion of the air and foamable liquid mixture prior to dispensing. It should be appreciated, however, that, in some embodiments and with some liquid and air mixtures, the mesh screen will not be needed due to the thorough mixing and agitation of the liquid and air in mixing chamber 14. The at least one mesh screen 44 may be provided in the form of a mixing cartridge 46 which consists of a hollow tube 48 bounded on both ends by mesh screens 44. Mixing cartridge 46, if provided, may further homogenize the resulting mixture to improve the quality of foam product that is dispensed at opening 40.

Figure 4:
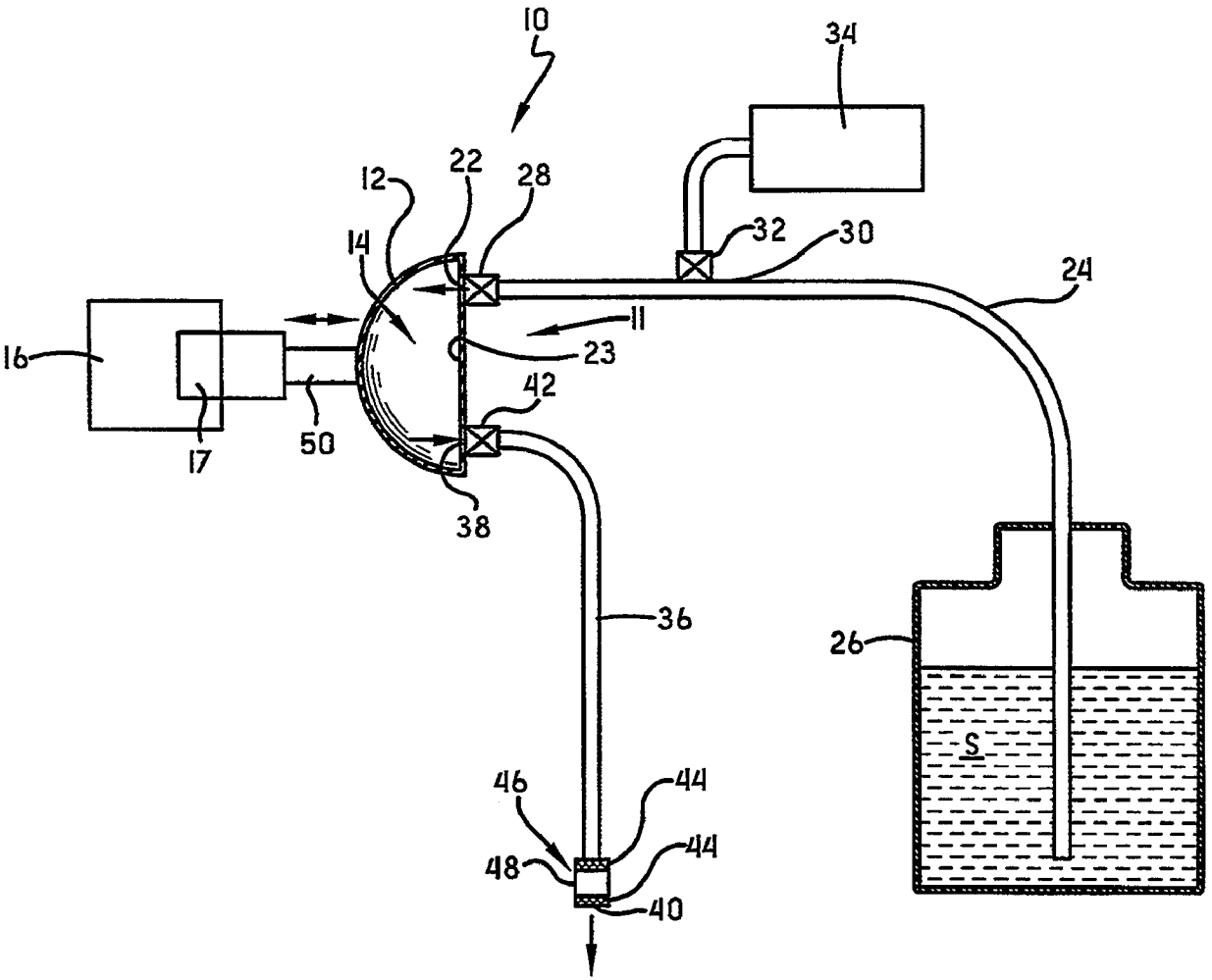
FIG. 4 is a schematic of an alternative dispenser according to the concepts of the present invention.

An alternative embodiment for rapidly expanding and collapsing diaphragm 12 is shown in FIG. 4, wherein the motor 16 drives a reciprocating piston 50 to press on diaphragm 12 and permit it to return to its expanded state, much like the rotation of cam 20. The reciprocation is represented by the double-headed arrow in FIG. 4. Thus, broadly, the motor 16 drives a motor-driven element to rapidly collapse and expand diaphragm 12 to draw air and liquid into the mixing chamber, violently mix them within the mixing chamber, and expel them as foam out to the outlet.

In light of the foregoing, it should be clear that this invention provides improvements in the art of foam pumps. While a particular embodiment has been disclosed herein for the purpose of teaching the inventive concepts, it is to be appreciated that the invention is not limited to or by any particular structure shown and described. Rather, the claims shall serve to define the invention.

What is claimed is:

1. A diaphragm foam pump comprising:

(a) a diaphragm made of a flexible material defining a mixing chamber and having an inlet opening and an outlet opening;

(b) an inlet passageway in fluid communication with a reservoir configured to contain a foamable liquid and said inlet opening, said inlet passageway having a one-way valve therein;

(c) an outlet passageway in fluid communication with said outlet opening, and having a one-way valve therein;

(d) an air inlet in said inlet passageway having a one-way valve;

(e) an electric motor;

(f) a motor-driven element associated with said electric motor;

wherein actuating said electric motor drives said motor driven element to repeatedly collapse and expand said diaphragm, and wherein expansion of said diaphragm creates a vacuum causing foamable liquid and air to flow into said mixing chamber in the form of a liquid and air mixture, and collapsing of said diaphragm causes the liquid and air mixture to be forced out through said outlet passageway as foam.

2. The diaphragm foam pump of claim 1, wherein said electric motor includes a rotating shaft; and said motor-driven element is a cam secured to said motor shaft, the actuation of said motor serving to rotate said motor shaft, causing said cam to repeatedly collapse and expand said diaphragm.

3. The diaphragm foam pump of claim 1, wherein said motor-driven element is a reciprocating rod, the actuation of said motor serving to reciprocate said rod, causing said rod to repeatedly collapse and expand said diaphragm.

4. The diaphragm foam pump of claim 1, wherein said outlet passageway includes at least one mesh screen.

5. The diaphragm foam pump of claim 1, wherein said inlet passageway includes a flow restrictor within the passageway to increase the velocity of the liquid flow therein at said air inlet.

6. The diaphragm foam pump of claim 1, further comprising an air pump providing pressurized air to said air inlet.

7. A diaphragm foam pump comprising:

(a) a diaphragm made of a flexible material defining a mixing chamber and having an inlet opening and an outlet opening;

(b) an inlet passageway in fluid communication with a reservoir configured to contain a foamable liquid and said inlet opening, said inlet passageway having a one-way valve therein;

(c) an outlet passageway in fluid communication with said outlet opening, and having a one-way valve therein;

(d) an air inlet in said inlet passageway having a one-way valve;

(e) the inlet passage having a reduced cross section proximate the air inlet;

(f) an electric motor; and (g) a motor-driven element associated with said electric motor;

wherein actuating said electric motor drives said motor driven element to repeatedly collapse and expand said diaphragm, and wherein expansion of said diaphragm creates a vacuum causing foamable liquid and air to flow into said mixing chamber in the form of a liquid and air mixture, and collapsing of said diaphragm causes the liquid and air mixture to be forced out through said outlet passageway as foam.

8. The diaphragm foam pump of claim 7 wherein the outlet passage comprising a tube having a first opening connected proximate the outlet of the diaphragm pump and a second opening, wherein at least one mesh screen is located adjacent the second opening.

9. The diaphragm foam pump of claim 7 wherein the outlet passage comprising a tube having a first opening connected proximate the outlet of the diaphragm pump and a second opening, and a mixing cartridge located proximate the second opening.

10. The diaphragm foam pump of claim 7 wherein the inlet passageway terminates near the bottom of the reservoir.

11. The diaphragm foam pump of claim 7 wherein an air inlet is located between the reservoir and diaphragm.

12. The diaphragm foam pump of claim 7 further comprising an air pump to force air into the inlet passage.

13. A diaphragm foam pump comprising:

(a) a diaphragm made of a flexible material defining a mixing chamber and having an inlet opening and an outlet opening;

(b) an inlet passageway extending from a reservoir configured to contain a foamable liquid to the inlet opening, said inlet passageway having a one-way valve therein;

(c) an outlet passageway in fluid communication with said outlet opening, and having a one-way valve therein;

(d) an air inlet in said inlet passageway having a one-way valve;

(e) the inlet passage having a reduced cross section proximate the air inlet;

(f) an electric motor;

(g) a motor-driven element associated with said electric motor; and (h) a foaming cartridge located in the outlet passageway;

wherein actuating said electric motor drives said motor-driven element to repeatedly collapse and expand said diaphragm, and wherein expansion of said diaphragm creates a vacuum causing foamable liquid and air to flow into said mixing chamber in the form of a liquid and air mixture, and collapsing of said diaphragm causes the liquid and air mixture to be forced out through said outlet passageway as foam.

14. The diaphragm foam pump of claim 13 wherein the one-way valve located in the outlet passageway is located proximate the diaphragm.

15. The diaphragm foam pump of claim 13 wherein air is drawn into the inlet passage by a venturi effect.

16. The diaphragm foam pump of claim 13 wherein air is forced into the inlet passage by an air pump.

* * * * *